US011311052B2

(12) United States Patent
Wang et al.

(10) Patent No.: US 11,311,052 B2
(45) Date of Patent: Apr. 26, 2022

(54) DEVICE WITH SEPARATE GAS INLET FOR CIGARETTE SET

(71) Applicant: CHINA TOBACCO YUNNAN INDUSTRIAL CO., LTD, Kunming (CN)

(72) Inventors: Ru Wang, Kunming (CN); Xu Zeng, Kunming (CN); Chengya Wang, Kunming (CN); Shanzhai Shang, Kunming (CN); Ping Lei, Kunming (CN); Jingmei Han, Kunming (CN); Zhiqiang Li, Kunming (CN); Dalin Yuan, Kunming (CN); Liheng Zhao, Kunming (CN); Jianrong Zhang, Kunming (CN); Yongkuan Chen, Kunming (CN); Hongyong Luo, Kunming (CN); Fengren Fang, Kunming (CN)

(73) Assignee: CHINA TOBACCO YUNNAN INDUSTRIAL CO., LTD, Kunming (CN)

( * ) Notice: Subject to any disclaimer, the term of this patent is extended or adjusted under 35 U.S.C. 154(b) by 663 days.

(21) Appl. No.: 16/341,444

(22) PCT Filed: Oct. 17, 2017

(86) PCT No.: PCT/CN2017/106532
§ 371 (c)(1),
(2) Date: Apr. 12, 2019

(87) PCT Pub. No.: WO2018/072682
PCT Pub. Date: Apr. 26, 2018

(65) Prior Publication Data

US 2021/0052006 A1 Feb. 25, 2021

(30) Foreign Application Priority Data

Oct. 18, 2016 (CN) ..... 201610906763.1

(51) Int. Cl.
*A24F 40/50* (2020.01)
*A24F 40/485* (2020.01)
(Continued)

(52) U.S. Cl.
CPC ..... *A24F 40/50* (2020.01); *A24F 40/485* (2020.01); *A24F 40/51* (2020.01); *A24F 40/20* (2020.01); *A24F 40/90* (2020.01)

(58) Field of Classification Search
CPC ..... A24F 40/20; A24F 40/50; A24F 40/51; A24F 40/90; A24F 40/485
See application file for complete search history.

(56) References Cited

U.S. PATENT DOCUMENTS

2005/0089314 A1* 4/2005 Chung et al. ..... A24F 40/485 131/194
2014/0196718 A1* 7/2014 Li ..... A24F 47/008 128/202.21
2014/0196733 A1 7/2014 Liu

FOREIGN PATENT DOCUMENTS

CN 202262413 U 6/2012
CN 203873000 U 10/2014
(Continued)

OTHER PUBLICATIONS

English machine translation of WO 2015120588 (Year: 2015).*

*Primary Examiner* — Liesl C Baumann
*Assistant Examiner* — Ronnie Kirby Jordan
(74) *Attorney, Agent, or Firm* — Bayramoglu Law Offices LLC

(57) ABSTRACT

A device with a separated gas inlet for cigarette set includes a controller switch, a controller switch seat, a transparent light guide seat, a filter holding seat, an insulation fixing sleeve, and a charging base. In the device with the separated gas inlet for cigarette set, air inlet channel for initiating a controller switch is separated from a smoke gas channel for
(Continued)

cigarette, thereby avoiding the failure of the controller switch caused by tarry matters of cigarette gas attaching on an initiating hole of the controller switch, and prolonging the service life of cigarette set.

3 Claims, 4 Drawing Sheets

(51) Int. Cl.

| | |
|---|---|
| ***A24F 40/51*** | (2020.01) |
| ***A24F 40/20*** | (2020.01) |
| ***A24F 40/90*** | (2020.01) |

(56) References Cited

FOREIGN PATENT DOCUMENTS

| | | | | | |
|---|---|---|---|---|---|
| CN | 104856238 | A | 8/2015 | | |
| CN | 105455198 | A | 4/2016 | | |
| CN | 106376977 | A | 2/2017 | | |
| WO | WO2015120588 | A1 * | 8/2015 | ..... | A24F 47/00 |

* cited by examiner

DEVICE WITH SEPARATE GAS INLET FOR CIGARETTE SET

CROSS REFERENCE TO THE RELATED APPLICATIONS

This application is the national phase entry of International Application No. PCT/CN2017/106532, filed on Oct. 17, 2017, which is based upon and claims priority to Chinese Patent Application No. 201610906763.1, filed on Oct. 18, 2016, the entire contents of which are incorporated herein by reference.

TECHNICAL FIELD

The present invention belongs to the field of electronic cigarette, specifically relates to a device with a separated gas inlet for cigarette set.

BACKGROUND

In the existing cigarette set for electronic cigarette, the traditional tobacco and controller switch share the same gas inlet channel, and the cigarette smoke passes through the hole on the controller switch. Since the smoke contains tarry matters, the tarry matters may attach on the hole, and with the increase of smoking cigarette, the tarry matters may accumulate to completely block the hole, causing a failure of the controller switch.

SUMMARY

In order to solve the above-mentioned problem, based on the existing structure with shared gas channel, the present invention provides a device with a separated gas inlet for cigarette set. Namely, air inlet channel for initiating a controller switch is separated from a smoke gas channel of a cigarette, avoiding the failure of the controller switch caused by tarry matters of traditional cigarette attaching on an initiating hole of the controller switch, and prolonging the service life of an electronic cigarette in cigarette set. A device with a separated gas inlet for cigarette set of the present invention includes:

a controller switch 2, wherein the controller switch is a cylindrical airflow sensor having two ends, and air can flow between the two ends;

a controller switch seat 3, wherein the controller switch seat is a cylinder-like structure with two ends, air can flow through each end, an inner cylinder is a controller switch hole 301 tightly attached to an outer wall of the controller switch 2, a wall perpendicular to an end of the controller switch seat 3 is provided with a U-shaped controller switch gas inlet channel 302 connecting an interior of the cylinder to an exterior of the cylinder, and the wall of the end is provided with an outer side wall groove 305, two grooves are provided along an axial direction of an outer side wall of the cylinder, namely, a first clamping guide groove 303 and a cigarette gas inlet channel 304, respectively;

a transparent light guide seat 4, wherein the transparent light guide seat is a cylinder-like structure closed in the middle, a second clamping guide groove 401 is provided along an axial direction of an inner side of an outer wall of the cylinder, a wall perpendicular to an end of the transparent light guide seat 4 is provided with a U-shaped controller switch gas inlet groove 403 connecting an interior of the cylinder to an exterior of the cylinder, and the end is provided with a controller switch matching protruding wall 404 projecting outwards and tightly attached to the outer side wall groove 305, a closed central part in the middle of the cylinder is a controller switch hole plug 402, a first cigarette gas inlet hole 405 connected to the cigarette gas inlet channel 304 is provided between the controller switch hole plug 402 and the cylinder wall;

a filter holding seat 5, wherein the filter holding seat 5 is a cylinder-like structure with a closed end, a plurality of small holes provided on the closed end are second cigarette gas inlet holes 502, a clamping guide column 501 protruding along an axial direction of the closed end is in an interference fit respectively with the first clamping guide groove 303 and the second clamping guide groove 401, the filter holding seat 5 is sealed and in a clearance fit with another end of the transparent light guide seat 4, and the controller switch seat 3 is in a interference fit with the transparent light guide seat 4;

the second cigarette gas inlet holes 502 are respectively connected to the first cigarette gas inlet hole 405 and the cigarette gas inlet channel 304 on the controller switch seat 3 through a gap between the filter holding seat 5 and the transparent light guide seat 4;

an insulation fixing sleeve 6, wherein the insulation fixing sleeve is in a cylindrical-like shape, and sleeves outside the filter holding seat 5 in an interference fit;

a charging base 7, wherein the charging base is in a cylindrical-like shape, an upper portion of the charging base is sleeved outside the insulation fixing sleeve 6 in an interference fit, a lower portion of the charging base is sleeved inside a mouthpiece tube 1, a middle portion of the charging base is provided with a plurality of gas guide holes 71 connected to the controller switch gas inlet groove 403 and the controller switch gas inlet channel 302;

the air enters the controller switch gas inlet groove 403 and the controller switch gas inlet channel 302 from the gas guide holes 71, and then enters the controller switch 2, to initiate the electronic cigarette;

while the smoke gas enters the gap between the filter holding seat 5 and the transparent light guide seat 4 from the second cigarette gas inlet holes 502 to enter the first cigarette gas inlet hole 405, and then enters the cigarette gas inlet channel 304, and thus the mouthpiece tube 1.

Preferably, the lower portion of the charging base 7 is sleeved inside the mouthpiece tube 1 in an interference fit.

Preferably, the cigarette gas inlet channel 304 is connected to the mouthpiece tube 1.

The working principle of the device with the separated gas inlet for cigarette set of the present invention is as follows.

The controller switch 2 is installed in the controller switch seat 3, the controller switch seat 3 is in an interference fit with the transparent light guide seat 4, and the controller switch gas inlet groove 403 is connected to the controller switch gas inlet channel 302. The transparent light guide seat 4 is in a clearance fit with the filter holding seat 5 to make the second cigarette gas inlet holes 502 connected to the gap between the filter holding seat 5 and the transparent light guide seat 4, the first cigarette gas inlet hole 405, and the cigarette gas inlet channel 304. The clamping guide column 501 is in an interference fit respectively with the first clamping guide groove 303 and the second clamping guide groove 401. The insulation fixing sleeve 6 is sleeved outside the filter holding seat 5 in an interference fit. The charging base 7 is sleeved outside the insulation fixing sleeve 6 in an interference fit, and an outer side of another end of the charging base 7 is in an interference fit with an inner side of the mouthpiece tube 1 to make the gas guide holes 71 connected to the controller switch gas inlet groove 403 and the controller switch gas inlet channel 302.

The air enters the controller switch gas inlet groove 403 and the controller switch gas inlet channel 302 from the gas guide holes 71, and then enters the controller switch 2, to initiate the electronic cigarette.

While, the smoke gas enters the gap between the filter holding seat 5 and the transparent light guide seat 4 from the second cigarette gas inlet holes 502 to enter the first cigarette gas inlet hole 405, then enters the cigarette gas inlet channel 304, and thus the mouthpiece tube 1 for user to smoke.

The advantages of the present invention are as follows.

Based on the existing structure sharing the same gas channel, the present invention provides a device with a separated gas inlet for cigarette set. Namely, air inlet channel for air initiating a controller switch is separated from smoke gas channel for cigarette, avoiding the failure of the controller switch caused by tarry matters of traditional cigarette attaching on an initiating hole of the controller switch, and prolonging the service life of cigarette set.

Figure 1:
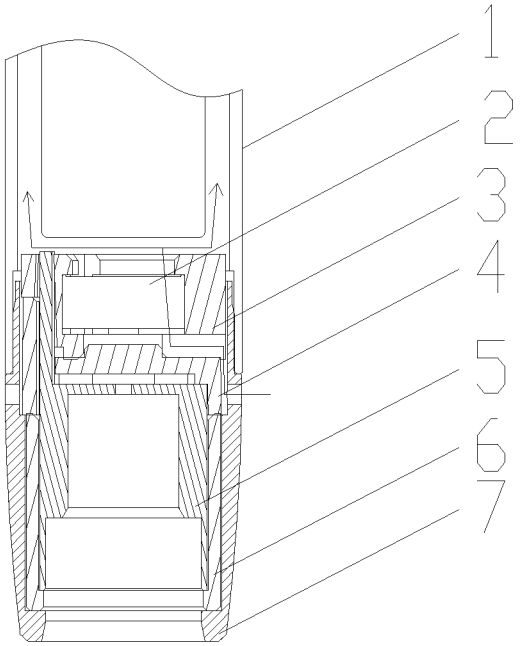
FIG. 1 is a schematic diagram showing a device with a separated gas inlet for cigarette set of the present invention in an assembled state and a flowing direction of gas initiating a controller switch.
Figure 2:
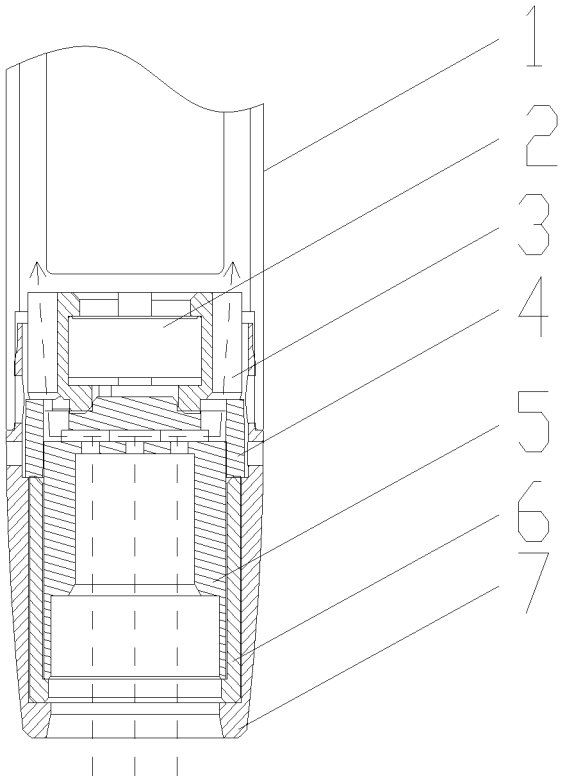
FIG. 2 is a schematic diagram showing a device with a separated gas inlet for cigarette set of the present invention in an assembled state and a flowing direction of smoke gas.
Figure 3:
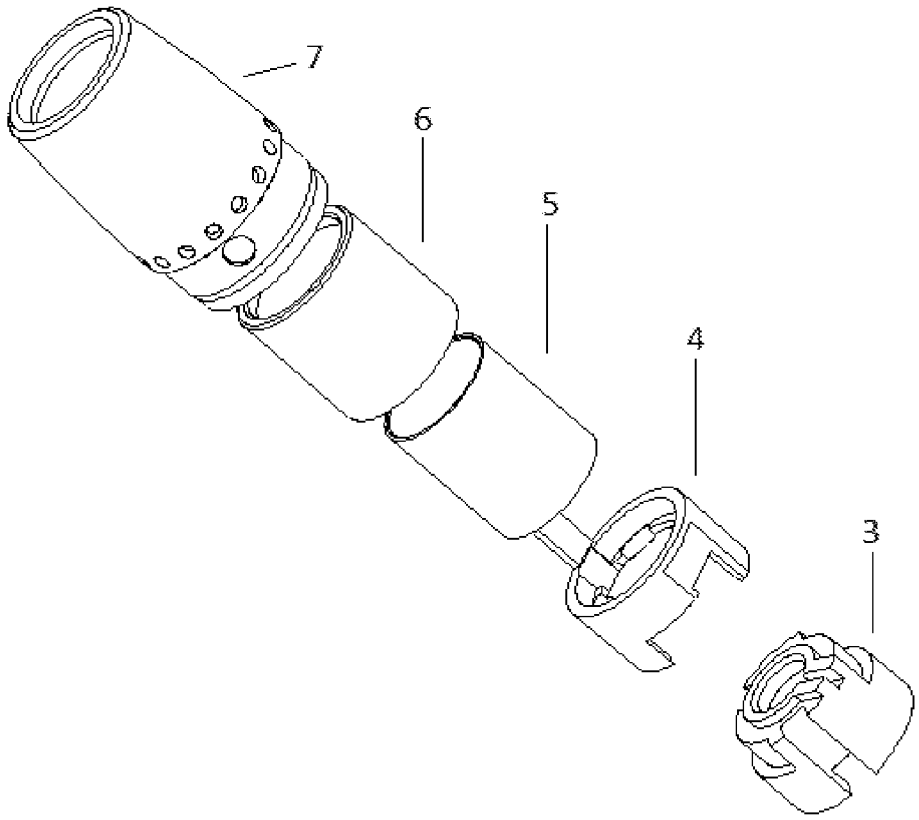
FIG. 3 is an exploded view of a device with a separated gas inlet for cigarette set of the present invention.
Figure 4:
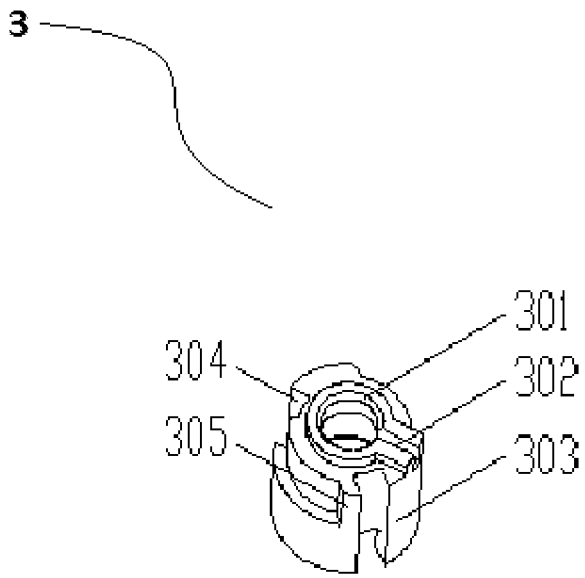
FIG. 4 is a schematic diagram of a controller switch seat of a device with a separated gas inlet for cigarette set of the present invention.
Figure 5:
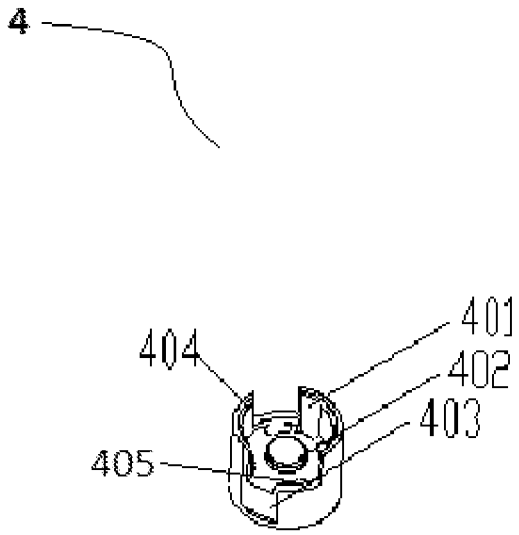
FIG. 5 is a schematic diagram of a transparent light guide seat of a device with a separated gas inlet for cigarette set of the present invention.
Figure 6:
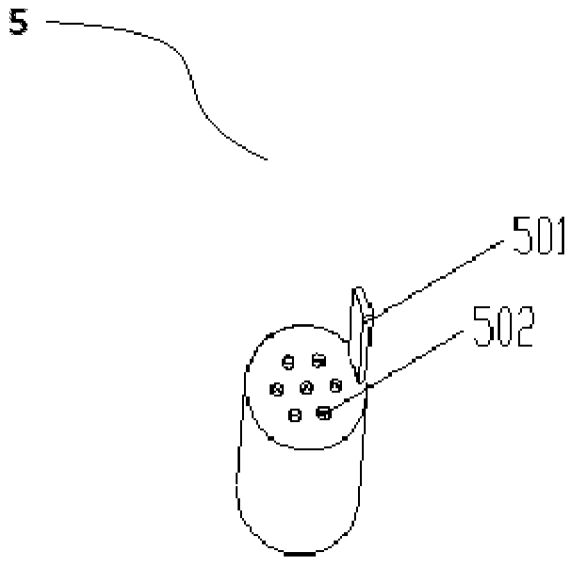
FIG. 6 is a schematic diagram of a filter holding seat of a device with a separated gas inlet for cigarette set of the present invention.
Figure 7:
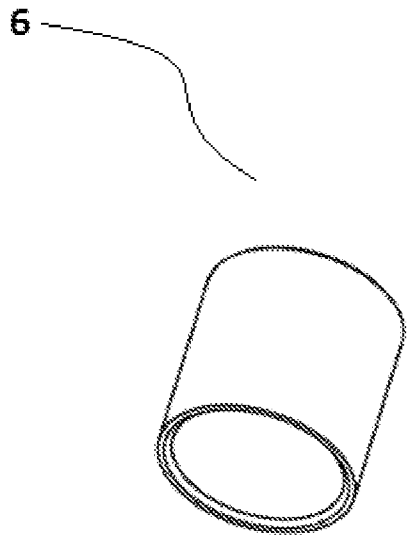
FIG. 7 is a schematic diagram of an insulation fixing sleeve of a device with a separated gas inlet for cigarette set of the present invention.
Figure 8:
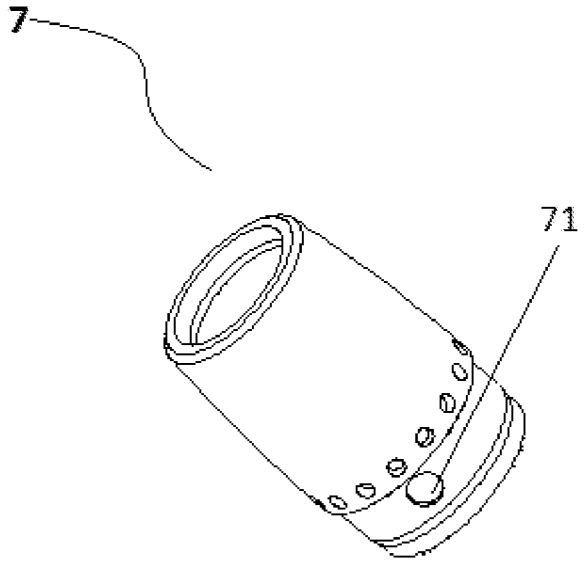
FIG. 8 is a schematic diagram of a charging base of a device with a separated gas inlet for cigarette set of the present invention.

The reference designators in the drawings are described hereinafter. 1—mouthpiece tube; 2—controller switch; 3—controller switch seat; 301—controller switch hole; 302—controller switch gas inlet channel; 303—first clamping guide groove; 304—cigarette gas inlet channel; 305—outer side wall groove; 4—transparent light guide seat; 401—second clamping guide groove; 402—controller switch hole plug; 403—controller switch gas inlet groove; 404—controller switch matching protruding wall; 405—first cigarette gas inlet hole; 5—filter holding seat; 501—clamping guide column; 502—second cigarette gas inlet hole; 6—insulation fixing sleeve; 7—charging base.

DETAILED DESCRIPTION OF THE EMBODIMENTS

The controller switch 2 is installed in the controller switch seat 3, the controller switch seat 3 is in an interference fit with the transparent light guide seat 4, and the controller switch gas inlet groove 403 is connected to the controller switch gas inlet channel 302. The transparent light guide seat 4 is in a clearance fit with the filter holding seat 5 to make the second cigarette gas inlet holes 502 connected to the gap between the filter holding seat 5 and the transparent light guide seat 4, the first cigarette gas inlet hole 405, and the cigarette gas inlet channel 304. The clamping guide column 501 is in an interference fit respectively with the first clamping guide groove 303 and the second clamping guide groove 401. The insulation fixing sleeve 6 is sleeved outside the filter holding seat 5 in an interference fit. The charging base 7 is sleeved outside the insulation fixing sleeve 6 in an interference fit, and an outer side of another end of the charging base 7 is in an interference fit with an inner side of the mouthpiece tube 1 to make the gas guide holes 71 connected to the controller switch gas inlet groove 403 and the controller switch gas inlet channel 302.

The air enters the controller switch gas inlet groove 403 and the controller switch gas inlet channel 302 from the gas guide holes 71, and then enters the controller switch 2, to initiate the electronic cigarette.

The smoke gas enters the gap between the filter holding seat 5 and the transparent light guide seat 4 from the second cigarette gas inlet holes 502 to enter the first cigarette gas inlet hole 405, and then enters the cigarette gas inlet channel 304, and thus the mouthpiece tube 1 for user to smoke.

What is claimed is:

1. A device with a separated gas inlet for cigarette set, comprising:

a controller switch, wherein the controller switch is a cylindrical airflow sensor having two ends, and air flows between the two ends of the controller switch;

a controller switch seat, wherein the controller switch seat is a first cylinder-like structure with two ends, the air flows through each end of the controller switch seat, an inner cylinder of the first cylinder-like structure is a controller switch hole tightly attached to an outer wall of the controller switch, a wall perpendicular to an end of the controller switch seat is provided with a controller switch gas inlet channel connecting an interior of the first cylinder-like structure to an exterior of the first cylinder-like structure, and a wall of the end is provided with an outer side wall groove, a first clamping guide groove and a cigarette gas inlet channel are provided along an axial direction of an outer side wall of the first cylinder-like structure, respectively;

a transparent light guide seat, wherein the transparent light guide seat is a second cylinder-like structure closed in a middle, a second clamping guide groove is provided along an axial direction of an inner side of an outer wall of the second cylinder-like structure, a wall perpendicular to a first end of the transparent light guide seat is provided with a controller switch gas inlet groove connecting an interior of the second cylinder-like structure to an exterior of the second cylinder-like structure, and the first end is provided with a controller switch matching protruding wall projecting outwards and tightly attached to the outer side wall groove, a closed central part at the middle of the second cylinder-like structure is a controller switch hole plug, a first cigarette gas inlet hole connected to the cigarette gas inlet channel is provided between the controller switch hole plug and a wall of the second cylinder-like structure;

a filter holding seat, wherein the filter holding seat is a third cylinder-like structure with a closed end, a plurality of small holes provided on the closed end are second cigarette gas inlet holes, a clamping guide column protruding along an axial direction of the closed end is in an interference fit respectively with the first clamping guide groove and the second clamping guide groove the filter holding seat is sealed and in a clearance fit with a second end of the transparent light guide seat, and the controller switch seat is in a interference fit with the transparent light guide seat;

the second cigarette gas inlet holes are respectively connected to the first cigarette gas inlet hole and the cigarette gas inlet channel on the controller switch seat through a gap between the filter holding seat and the transparent light guide seat;

an insulation fixing sleeve, wherein the insulation fixing sleeve is in a first cylindrical-like shape, and sleeves outside the filter holding seat in an interference fit;

a charging base, wherein the charging base is in a second cylindrical-like shape, an upper portion of the charging base is sleeved outside the insulation fixing sleeve in an interference fit, a lower portion of the charging base is sleeved inside a mouthpiece tube, a middle portion of the charging base is provided with a plurality of gas guide holes connected to the controller switch gas inlet groove and the controller switch gas inlet channel;

air enters the controller switch gas inlet groove and the controller switch gas inlet channel from the plurality of gas guide holes, and then enters the controller switch, to initiate an electronic cigarette;

smoke gas enters the gap between the filter holding seat and the transparent light guide seat from the second cigarette gas inlet holes to enter the first cigarette gas inlet hole, then enters the cigarette gas inlet channel, and thus enters the mouthpiece tube.

2. The device with the separated gas inlet for cigarette set of claim 1, wherein the lower portion of the charging base is sleeved inside the mouthpiece tube in an interference fit.

3. The device with the separated gas inlet for cigarette set of claim 1, wherein the cigarette gas inlet channel is connected to the mouthpiece tube.

* * * * *